United States Patent [19]

Jannemann et al.

[11] Patent Number: 4,960,378

[45] Date of Patent: Oct. 2, 1990

[54] GAS BURNER

[75] Inventors: Theo Jannemann, Dorsten; Hans Berg, Gladbeck, both of Fed. Rep. of Germany

[73] Assignee: Ruhrgas Aktiengesellschaft, Essen, Fed. Rep. of Germany

[21] Appl. No.: 248,531

[22] Filed: Sep. 23, 1988

[30] Foreign Application Priority Data

Sep. 26, 1987 [DE] Fed. Rep. of Germany ..... 3732482

[51] Int. Cl.[5] ..... F23D 11/40

[52] U.S. Cl. ..... 431/114; 431/326; 431/346; 431/354; 239/432; 239/553.3; 239/567

[58] Field of Search ..... 431/114, 326, 328, 329, 431/346, 347; 239/432, 553.3, 567

[56] References Cited

U.S. PATENT DOCUMENTS

| | | | |
|---|---|---|---|
| 3,291,187 | 12/1966 | Haensel | 431/329 |
| 3,445,175 | 5/1969 | Krieger | 431/328 |
| 3,489,134 | 1/1970 | Cowan | 431/328 X |
| 3,736,095 | 5/1973 | Leatherby | 431/328 X |
| 3,975,140 | 8/1976 | Placek | 431/329 |
| 4,541,407 | 9/1985 | Sommers et al. | 431/346 X |

FOREIGN PATENT DOCUMENTS

| | | | |
|---|---|---|---|
| 0235789 | 9/1987 | European Pat. Off. | 431/354 |
| 2321663 | 3/1977 | France | 431/328 |

*Primary Examiner*—Carl D. Price

*Attorney, Agent, or Firm*—Blakely, Sokoloff, Taylor & Zafman

[57] ABSTRACT

The gas burner comprises a mixer, a conical transition member adjacent thereto on which a cylindrical burner shell with openings and whose top is closed by a burner lid is mounted. Clamped between the burner lid and the transition member is a throttling cylinder which is filled by the super-stoichiometric gas mixture at super-atmospheric pressure. In order to avoid burner pulsations the cylinder has throttling openings whose total area is 2 to 10% of the total area of the openings. The throttling openings are in a plurality of circular rows above one another in such a manner that they are on a respective vertical line. Vertical, imperforate sections of the burner shell are opposed to the lines so that the mixture jets from the throttling openings do not impinge directly on the openings. The cylinder is provided at a coaxial spacing of 5 mm from the burner shell.

20 Claims, 3 Drawing Sheets

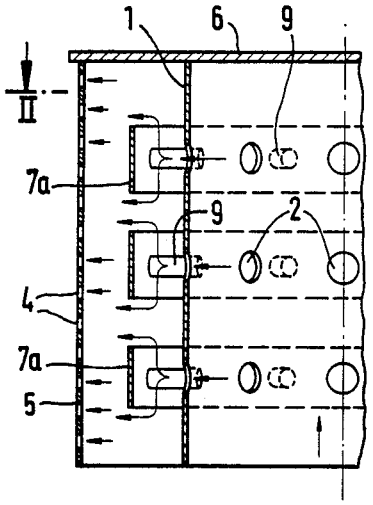
FIG.1
FIG.2
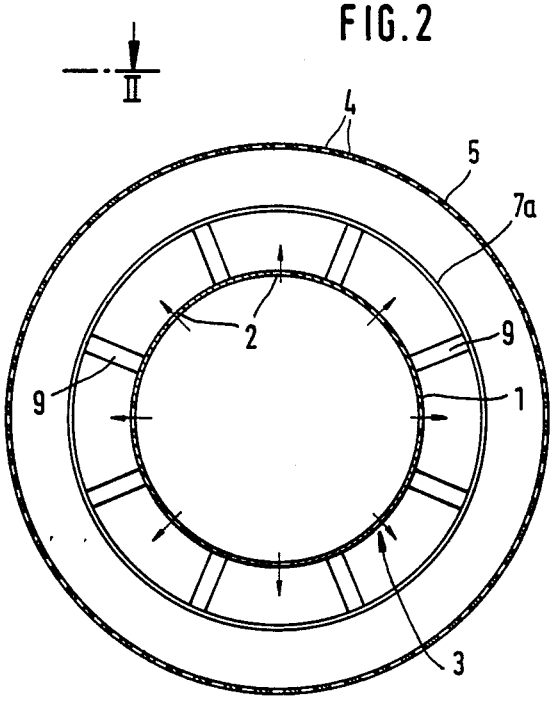
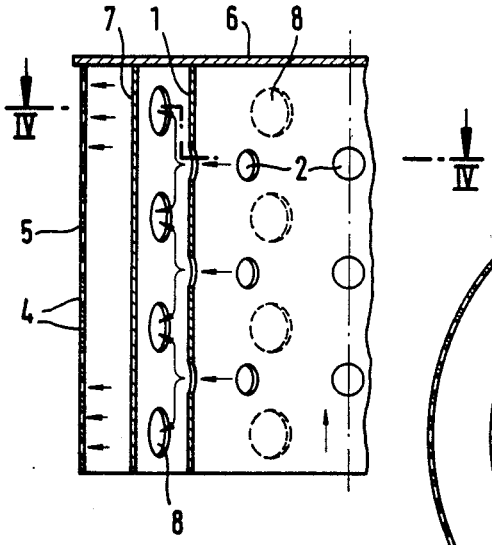
FIG.3
FIG.4
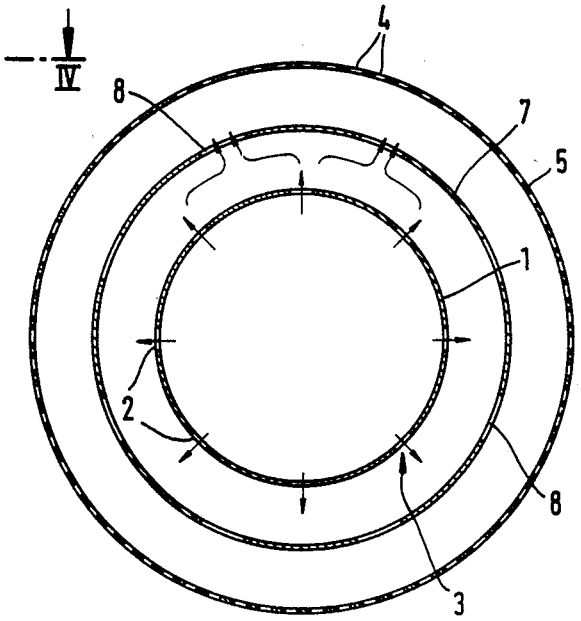

FIG.5
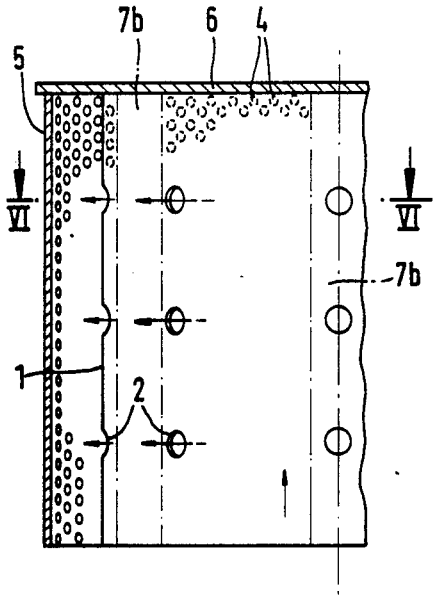
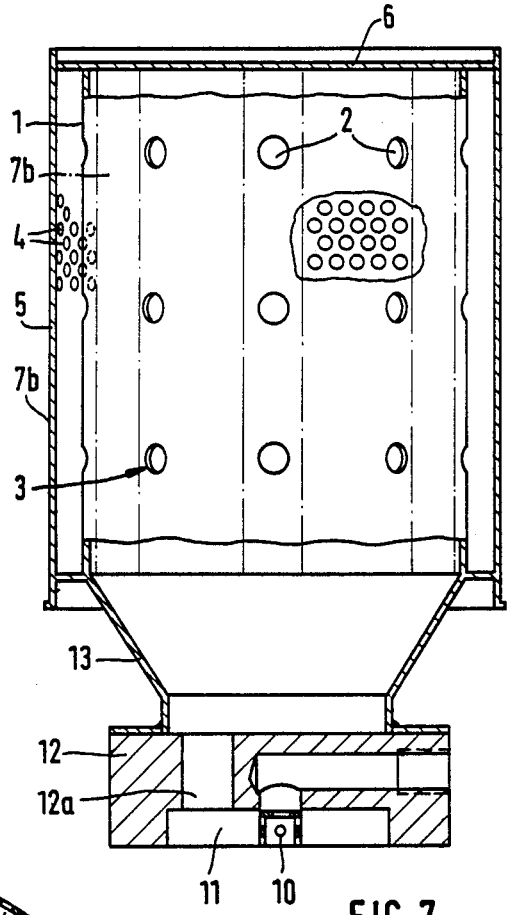
FIG.7
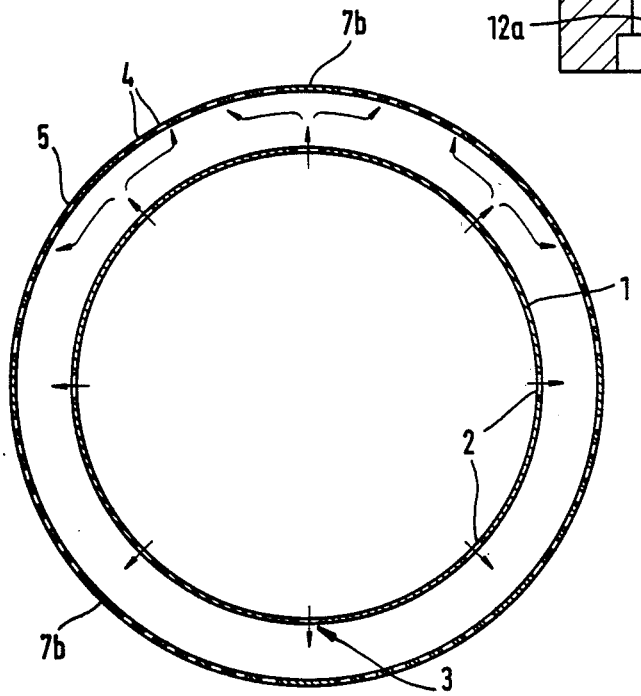
FIG.6

GAS BURNER

BACKGROUND OF THE INVENTION

1. Field of the invention

The invention relates to a blower-assisted, super-stoichiometrically premixing gas burner with a partition wall arranged between a combustion space and a mixture space which has openings for the mixture and with a throttle arranged in the mixture space upstream of the partition wall.

2. Prior art

Such a gas burner is disclosed in EP-B No. 0092838. In this specification a burner plate is provided as the partition wall. A portion of bent metal plate is arranged in the mixture passage upstream of this plate in order to supress burner pulsations due to the throttling action. The mere provision of this metal plate is however not completely satisfactory as regards its effect.

THE INVENTION

It is the object of the invention further to develop a gas burner of the type referred to above in such a manner that the throttle can fully fulfil its purpose.

After lengthy experiments into the cause and removal of the burner pulsations which occur the solution of this object resides in that for the purpose of decoupling the combustion space from the mixture space as regards pulsations the throttle defines at least one throttling opening with a total cross-sectional area which is 2 to 10%, preferably 2 to 5%, of the total cross-sectional area of the openings in the partition wall. This rule represents a lasting cure in that the throttle causes a high pressure loss of the gas-air mixture which is transferred at super-atmospheric pressure and thereby effects the separation of the mixture space from the combustion space as regards pulsations to a substantial extent.

As has been subsequently successfully proved by testing, the features in accordance with the invention result surprisingly in the reproduceable supression of the burner pulsations practically over the entire range of performance and air flow with all types of burner constructions. Whistling and howling noises disappear entirely. A significant improvement in the mixture distribution also occurs so that corresponding distributor installations can be omitted. Particularly advantageous is the fact that the pressure of conventional blowers is fully sufficient for troubleproof operation of the gas burner and thus after completed mixing of the combustion gas with the air there is still sufficient pressure to be able to cope without difficulty with the pressure loss caused by the throttling.

These advantages occur pronouncedly when the throttle is arranged at a spacing of about 5 to 30 mm from the partition wall. A particularly advantageous embodiment for use in gas heating boilers with a cylindrical combustion chamber resides in that the partition wall and the throttle are constructed as cylindrical components which at their one end are retained by a transition member at the mixer end and at their other end are connected to a burner lid. One of the cylindrical components is firmly connected not only to the transition member but also to the burner lid whilst at least one end of the other cylindrical component engages longitudinally displaceably in a guide on the transition member or the burner lid. By virtue of this arrangement the components can expand unimpeded at the severe varying temperature stresses which occur. In this manner damage due to thermal expansion is avoided.

The partition wall should be provided on both sides with kick-back preventers. For this purpose heat-resistant, soft seals can advantageously be inserted in the guides.

It is particularly advantageous if the partition wall represents that cylindrical component which is firmly connected not only to the transition member but also to the burner lid.

A further improvement of the mixture distribution is achieved if obstacles are provided to the high mixture outlet pulses so that the mixture streams do not directly impinge-against the openings in the partition wall. In this connection it is convenient to position an impingement element opposite the throttling opening and downstream of it. This can advantageously be arranged as a separate component between the throttle and the partition wall.

In accordance with the invention the impingement element has apertures which are arranged offset relative to the throttling openings of the throttle.

Tests have shown that it is particularly favourable if the apertures in the impingement element have a total cross-sectional area of at least 30%, preferably 40 to 70%, of the total cross-sectional area of the openings in the partition wall.

At least one cylindrical component is advantageously provided as the impingement element.

In a preferred embodiment the impingement element, which is constructed as a cylindrical component, is retained at its one end by the transition member and is connected at its other end to the burner lid, at least one end of the impingement element engaging longitudinally displaceably in a guide on the transition member or the burner lid. In this manner damage of this component due to thermal expansion is avoided.

In an alternative embodiment the separate sheet metal cylinder is omitted and the burner shell itself permitted to act as the impingement element by providing inperforate sections on the burner shell.

A particularly simple and economical construction of the gas burner is produced if a cylindrical burner shell, preferably with a thickness of 0.5 to 1.3 mm, is provided to form the partition wall, which adjoins the mixer with a rotationally symmetrical transition member, is closed at its end by a burner lid and is provided with the openings, which have a hydraulic diameter of 0.8 to 1.5 mm, in a hexagonal configuration whereby a cylinder, which has the throttling openings in circular rows, arranged within the burner shell between the transition member and the burner lid serves as the throttle.

The invention will be described below with reference to exemplary embodiments which are schematically illustrated in the drawings.

BRIEF DESCRIPTION OF THE DRAWINGS

FIG. 1 is a cross-sectional view through the cylindrical axis of a cylindrical gas burner, FIG. 2 is a sectional view on the line II—II in FIG. 1, FIG. 3 is a sectional view corresponding to FIG. 1 of a further embodiment of the cylindrical gas burner, FIG. 4 is a sectional view on the line IV—IV in FIG. 3, FIG. 5 is a sectional view corresponding to FIG. 1 of a third embodiment of the cylindrical gas burner, FIG. 6 is a sectional view on the line VI—VI in FIG. 5, FIG. 7 is a sectional view corresponding to FIG. 1 of a fourth embodiment of the cylindrical gas burner and FIG. 8 is a sectional view corresponding to FIG. 3 of a fifth embodiment of the cylindrical gas burner.

DETAILED DESCRIPTION OF THE INVENTION

Figure 8:
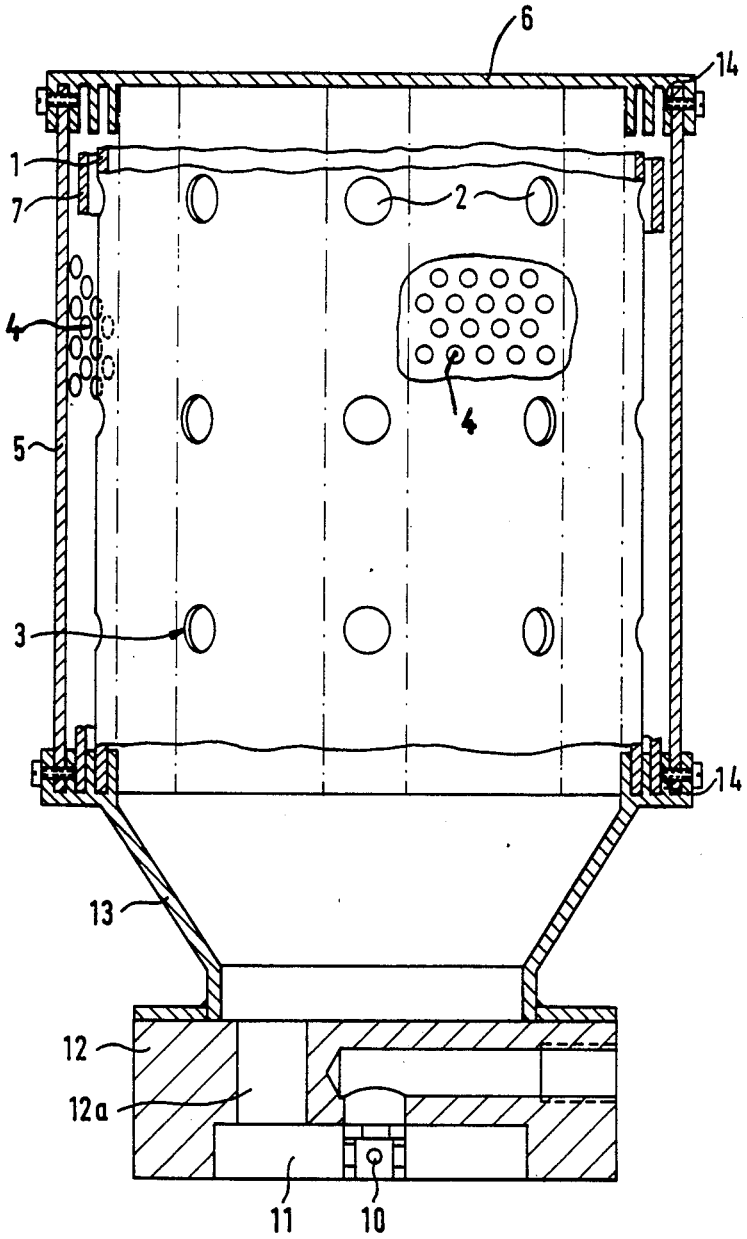

In FIGS. 1 to 6 the arrows which have no reference numeral indicate the flow pattern of a super-stoichiometric gas-air mixture which enters a cylinder 1 at a super-atmospheric pressure from below as seen in the drawing, passes through its throttling openings 2, which are arranged above one another in circular rows 3 and finally leaves substantially radially through openings 4 in a cylindrical burner shell 5 and is there uniformly burnt, as is partially shown with arrowheads in FIGS. 2,4 and 6. The cylinder 1 and the burner shell 5 are closed at the top by a common burner lid 6.

In FIGS. 1 to 4, the arrangement is such that the throttling cylinder 1 maintains a coaxial spacing up to 30 mm from the burner shell 5 and the total cross-sectional area of the throttling openings 2 is 2 to 10%, preferably 2 to 5%, of the total cross-sectional area of the openings 4 in order to prevent burner pulsations. An impingement element is provided between the cylinder 1 and the burner shell 5 in order that the pulses of the mixture jets, which are produced in the intense throttling process, are inhibited. As shown in FIGS. 3 and 4, this comprises a single sheet metal cylinder 7 fastened at its ends and with apertures 8 which are arranged offset from the throttling openings 2 both vertically and peripherally. The apertures 8 have a total cross-sectional area of at least 30%, preferably 40 to 70%, of the total cross-sectional area of the openings 4 in the partition wall 5. In FIGS. 1 and 2 the impingement element comprises a plurality of sheet metal cylinders 7*a* which each annularly cover a respective circular row 3 of the throttling openings 2 and are secured by spacers 9 to the cylinder 1.

To avoid burner pulsations the construction of FIGS. 5 and 6 is constructed similarly to the embodiments described above. The throttling cylinder 1 is however provided in this case at a spacing of only 5 mm from the burner shell 5. Imperforate vertical sections 7*b* of the burner shell 5, which are opposed to the throttling openings 2 situated above one another, serve as the impingement element. In FIGS. 7 and 8 the combustion gas flows through the gas nozzle 10 into a chamber 11 of a mixer 12 which is constructed as an orifice mixer. The combustion air is supplied to the chamber 11 with the aid of a blower which is not illustrated. The mixture flows through bores 12*a* (of which only one is shown) and a conically broadening transition member 13 into the cylinder 1 which is arranged within the burner shell 5, as shown in FIG. 5. The thickness of the burner shell 5 is between 0.05 and 2 mm. The burner shell 5 has the openings 4 in a hexagonal configuration whose hydraulic diameter is 0.8 to 1.5 mm. A high degree of perforation and thus a low outlet surface loading is achieved at a high total surface loading by virtue of the hexagonal configuration of these openings.

FIG. 8 differs from FIG. 7 only in that the sheet metal cylinder 7 serves as the impingement element and in the nature of the mounting of the three cylindrical elements 1,5 and 7. The burner lid 6 or the transition member 13 have guides 14 in which the burner shell 5, the sheet metal cylinder 7 and the cylinder 1 engage. The guides are shown on the burner lid side without the cylindrical elements 1 and 7 for the purpose of clarity: The burner shell 5 is screwed to the burner lid 6 and the transition member 13 in a kick-back proof manner. The cylinder 1 and the sheet metal cylinder 7 are mounted in the guides 14 so as to be longitudinally displaceable.

The burners illustrated in the drawings can be installed, depending on the application, both suspended, i.e. with the burner lid directed downwardly, and also upright, i.e. with the burner lid directed upwardly.

The suspended manner of installation is particularly advantageous for gas heating boilers with exhaust gas condensation since the condensate can drip away without impinging on the burner.

We claim:

1. Gas burner of the type which uses a pressurized super-stoichiometric mixture, comprising:

a partition wall (5) forming a flame supporting burner plate which is arranged between a combustion space and a mixture space, the partition wall having openings (4) for the mixture, a throttle (1) which is arranged in the mixture space upstream of the partition wall, the throttle (1) defining at least one throttling opening (2) for decoupling the combustion space from the mixture space as regards pulsations, wherein the sum of the cross-sectional area of each of said at least one throttling opening (2) is 2 to 10% of the sum of the cross-sectional area of each of said wall openings (4).

2. Gas burner as claimed in claim 1 wherein the throttle (1) is arranged at a spacing of about 5 to 30 mm from the partition wall (5).

3. Gas burner as claimed in claim 1 wherein the partition wall (5) and the throttle (1) are constructed as cylindrical components, the cylindrical components are retained at their one end by a transition member (13) at the mixer end and are connected at their other end to a burner lid (6), and one of the cylindrical components (1 or 5) is firmly connected both to the transition member (13) and also to the burner lid (6) whilst at least one end of the other cylindrical component (1 or 5) engages in a longitudinally displaceable manner in a guide (14) on the transition member (13) or the burner lid (6).

4. Gas burner as claimed in claim 3 wherein the partition wall (5) represents that cylindrical component which is firmly connected not only to the transition member (13) but also to the burner lid (6).

5. Gas burner as claimed in claim 1 wherein the throttling opening (2) is opposed to an impingement element downstream thereof.

6. Gas burner as claimed in claim 5 wherein a separate element constituting the impingement element is arranged between the throttle (1) and the partition wall (5).

7. Gas burner as claimed in claim 5 wherein a separate component constituting the impingement element is arranged between the throttle (1) and the partition wall (5), the impingement element has apertures (8) and the apertures are arranged offset with respect to the throttling openings (2) of the throttle (1).

8. Gas burner as claimed in claim 5 wherein a separate component constituting the impingement element is arranged between the throttle (1) and the partition wall (5), the impingement element has apertures (8), the apertures are arranged offset with respect to the throttling openings (2) of the throttle (1), and the apertures have a total cross-sectional area of at least 30% of the total cross-sectional area of the openings (4) in the partition wall (5).

9. The gas burner defined by claim 8 wherein the total cross-sectional area of the apertures is 40%–70% of the total cross-sectional area of the openings in the partition wall.

10. Gas burner as claimed in claim 5 wherein at least one cylindrical component (7,7*a*) is provided as the impingement element.

11. Gas burner as claimed in claim 3 wherein the throttling opening (2) is opposed to an impingement element (7,7*a*) downstream thereof.

12. Gas burner as claimed in claim 3 wherein the throttling opening is opposed to an impingement element downstream thereof, and the impingement element is arranged as a separate component between the throttle (1) and the partition wall (5).

13. Gas burner as claimed in claim 3 wherein the throttling opening (2) is opposed to an impingement element downstream thereof, the impingement element has apertures (8) which are arranged offset with respect to the throttling openings (2) of the throttle (1).

14. Gas burner as claimed in claim 3 wherein the throttling opening (2) is opposed to an impingement element downstream thereof, and at least one cylindrical component is provided as an impingement element.

15. Gas burner as claimed in claim 3 wherein a cylindrical impingement element is arranged between the throttle (1) and the partition wall (5), the impingement element is retained at its one end by the transition member (13) and is connected at its other end to the burner lid (6), and at least one end of the impingement element engages longitudinally displaceably in a guide (14) on the transition member (13) or the burner lid (6).

16. Gas burner as claimed in claim 5 wherein an imperforate section (7*b*) of the partition wall (5) constitutes the impingement element.

17. Gas burner as claimed in claim 3 wherein the throttling opening (2) is opposed to an impingement element downstream thereof and an imperforate section (7*b*) of the partition wall (5) constitutes the impingement element.

18. Gas burner as claimed in claim 3 comprising a cylindrical burner shell (5) for forming the partition wall, the burner shell having a thickness of 0.5 to 2.0 mm, preferably of 0.5 to 1.3 mm, a rotationally symmetrical transition member (13), the transition member being arranged between the burner shell (5) and a mixer (12), a burner lid (6), the burner lid closing the burner shell (5) at its end, the burner shell having openings (4) in a hexagonal configuration, the openings having a hydraulic diameter of 0.5 to 1.5 mm, a cylinder (1), the cylinder forming the throttle, the cylinder being arranged within the burner shell between the transition member and the burner lid, and the cylinder (1) having the throttling openings (2) in circular rows (3).

19. Gas burner as claimed in claim 1 comprising a cylindrical burner shell (5) for forming the partition wall, the burner shell having a thickness of 0.5 to 2.0 mm, preferably of 0.5 to 1.3 mm, a rotationally symmetrical transition member (13), the transition member being arranged between the burner shell (5) and a mixer (12), a burner lid (6), the burner lid closing the burner shell (5) at its end, the burner shell having the openings (4) in a hexagonal configuration, the openings having a hydraulic diameter of 0.5 to 1.5 mm, a cylinder (1), the cylinder forming the throttle, the cylinder being arranged within the burner shell between the transition member and the burner lid, and the cylinder (1) having the throttling openings (2) in circular rows (3).

20. The gas burner defined by claim 1 wherein the sum of the cross-sectional area of each of said throttling opening (2) is 2% to 5% of the sum of the cross-sectional area of each of said wall openings (4).

* * * * *

UNITED STATES PATENT AND TRADEMARK OFFICE

CERTIFICATE OF CORRECTION

PATENT NO. : 4,960,378

DATED : 10/2/90

INVENTOR(S) : Jannemann et al.

It is certified that error in the above-identified patent and that said Letters Patent is hereby corrected as shown below:

| | | |
|---|---|---|
| col. 02, line 14 | delete "impinge-against" | insert --impinge against-- |
| col. 03, line 56 | delete "0.05" | insert --0.5-- |

Signed and Sealed this

Twenty-sixth Day of January, 1993

*Attest:*

STEPHEN G. KUNIN

*Attesting Officer*

*Acting Commissioner of Patents and Trademarks*